United States Patent [19]

Bachmann

[11] 4,382,729

[45] May 10, 1983

[54] DEPTH OF CUT ADJUSTMENT MECHANISM FOR A POWER PLANER

[75] Inventor: Rainer Bachmann, Hohenstein, Fed. Rep. of Germany

[73] Assignee: Black & Decker Inc., Newark, Del.

[21] Appl. No.: 194,840

[22] Filed: Oct. 2, 1980

[51] Int. Cl.[3] ..... B27C 1/10

[52] U.S. Cl. ..... 409/178; 144/117 C; 145/4

[58] Field of Search ..... 409/175, 178, 181; 144/117 C; 30/128, 377; 145/4, 4.1, 4.2, 20

[56] References Cited

U.S. PATENT DOCUMENTS

| | | | |
|---|---|---|---|
| 165,355 | 7/1875 | Miller | 145/20 X |
| 1,366,389 | 1/1921 | Kraber | 145/4 |
| 2,265,354 | 12/1941 | Dahl | 144/117 C X |
| 2,562,832 | 7/1951 | Strandberg | 144/117 C X |
| 2,746,499 | 5/1956 | Greeley | 145/4.2 |
| 2,871,897 | 2/1959 | Hesse et al. | 145/4 |
| 3,354,784 | 11/1967 | Zemberry | 409/178 |

FOREIGN PATENT DOCUMENTS

| | | |
|---|---|---|
| 1030988 | 5/1958 | Fed. Rep. of Germany . |
| 563376 | 9/1923 | France . |
| 297502 | 3/1954 | Switzerland . |
| 248253 | 3/1926 | United Kingdom . |
| 1386357 | 3/1975 | United Kingdom . |

*Primary Examiner*—Z. R. Bilinsky

*Attorney, Agent, or Firm*—Walter Ottesen; Edward D. Murphy; Ronald B. Sherer

[57] ABSTRACT

A depth of cut adjustment mechanism for a portable power planer having an adjustable front shoe whose elevational position controls the depth of cut of the tool. An S-shaped rod is fastened at one end to the adjustable front shoe and is threadedly engaged at its other end to an adjustment nut rotatably mounted in a race formed in the housing. A control knob having disposed thereon a scale referenced to a mark on the housing is secured to the nut so that rotation of the control knob causes a corresponding adjustment in the elevational position of the front shoe. A tension spring is connected between the front shoe and the housing to cancel out inherent tolerance play between the front shoe and the housing.

8 Claims, 12 Drawing Figures

FIG. 1.
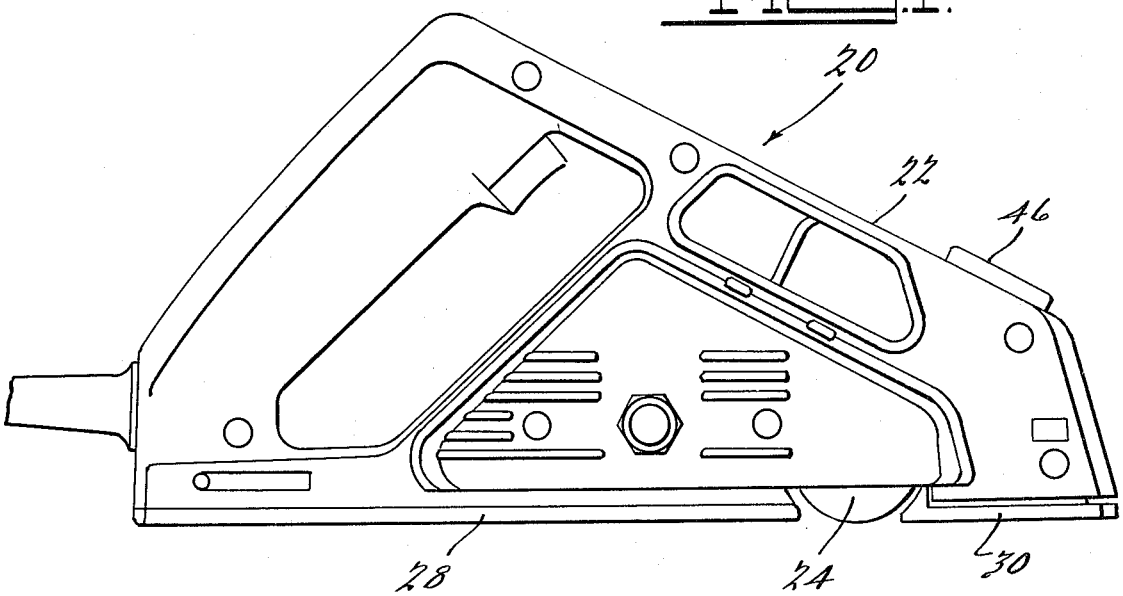
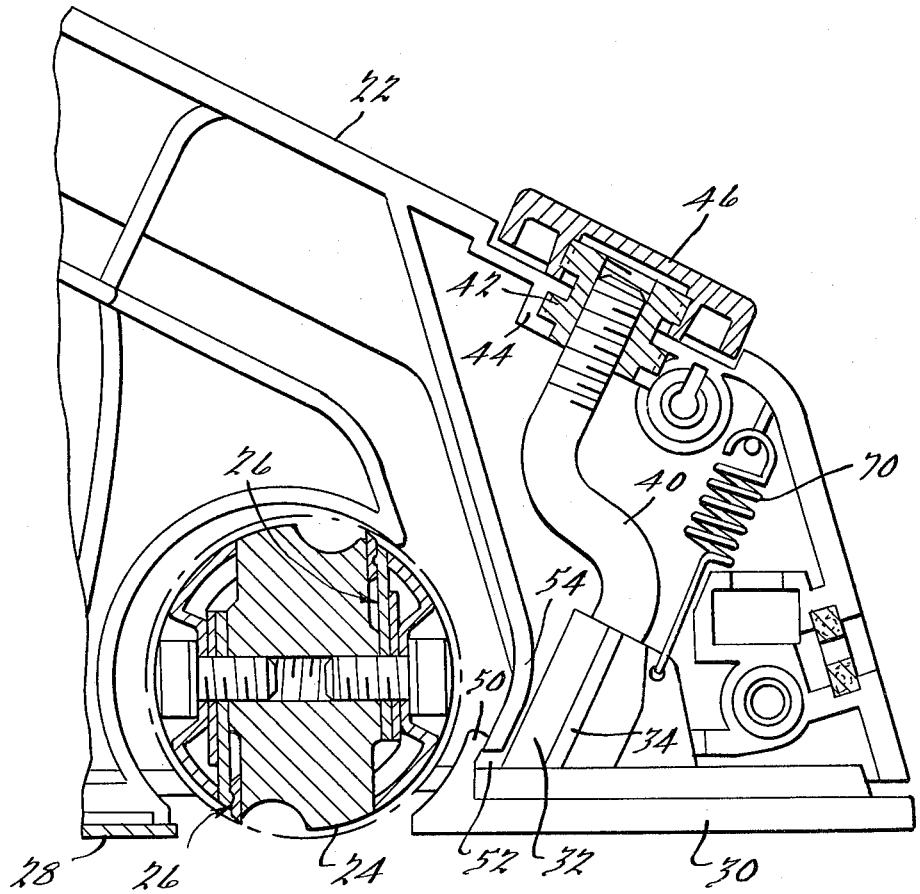
FIG. 2.

DEPTH OF CUT ADJUSTMENT MECHANISM FOR A POWER PLANER

BACKGROUND AND SUMMARY OF THE INVENTION

The present invention relates to portable power planers and in particular to an improved depth of cut adjustment mechanism for a power planer. In general, portable power planers comprise a motor driven rotary cutter head having one or more cutting blade assemblies disposed thereon for performing a planing operation on the surface of a workpiece as the cutter head rotates. The bottom surface of the tool consists of a fixed shoe located rearwardly of the cutter head and an adjustable shoe disposed forwardly of the cutter head. As the front shoe is adjusted upwardly or downwardly the cutting depth of the cutting blade of the planar is adjusted accordingly.

The adjustable front shoe of a portable power planer typically includes an integral stem or sleeve that is threaded either directly to an adjustment cap disposed atop the front end of the housing or to a threaded shaft or bolt that is in turn fastened at its other end to the adjustment cap for rotation therewith. In either arrangement, however, a powerful compression spring is interposed about the sleeve between the shoe and the housing to maintain the elevation of the adjustable shoe in the position set by the operator. The compression spring is held in compression between the adjustable shoe and the housing and must be of sufficient strength to resist the natural tendency of the operator to bear down upon the planer when performing a planing operation, and yet be sufficiently compressible to permit convenient upward adjustment of the adjustable front shoe. As a consequence, in some planers having conventional depth of cut adjustment mechanisms, the operator can overcome the thrust force of the compression spring and dislodge the adjustable shoe from its preset position, thereby causing an undesired variation in the depth of cut.

Accordingly, it is the primary object of the present invention to provide an improved depth of cut adjustment mechanism for a portable power planer which accurately maintains the preset position of the adjustable shoe when the operator bears down upon the tool.

Additionally, it is an object of the present invention to provide such a depth of cut adjustment mechanism for a power planer which utilizes a tension spring which works with the operator to take up the tolerance play at the interface between the adjustable shoe and the tool housing.

Furthermore, it is an object of the present invention to provide such a depth of cut adjustment mechanism for a power planer that substantially reduces the space required within the tool housing, as well as the manufacturing cost of the tool, as compared to conventional prior art constructions.

In general, the elevation adjustment arrangement according to the present invention includes an adjustable shoe having fixedly attached thereto a rod extending upwardly therefrom which is threadedly engaged at its upper end to an elevation positioning nut rotatably mounted in the housing and fixed against elevational movement relative thereto. An adjustment cap disposed atop the housing is affixed to the positioning nut so that rotation of the adjustment cap results in elevational movement of the adjustable front shoe. A tension spring is connected between the front end of the adjustable shoe and the housing to cancel out tolerance play between the adjustable shoe and the housing. Because the tension spring works with the operator as he bears down upon the tool, no unwanted movement or wobble of the adjustable front shoe results.

In addition, the preferred embodiment of the present invention includes means for calibrating the elevation adjustment mechanism so that when the scale provided on the adjustment cap reads zero, the adjustable shoe is set for zero cutting depth. A positive park position is also provided which when engaged sets the adjustable shoe below zero elevation so that the cutting blades will not mar the surface upon which the tool is placed.

Additional objects and advantages of the present invention will become apparent from a reading of the detailed description of the preferred embodiment which makes reference to the following set of drawings in which:

BRIEF DESCRIPTION OF THE DRAWINGS

FIG. 1 is a side elevational view of a power planer incorporating the depth of cut adjustment mechanism according to the present invention;

FIG. 2 is an enlarged detailed cutaway view exposing the depth of cut adjustment mechanism according to the present invention;

DETAILED DESCRIPTION OF THE PREFERRED EMBODIMENT

Figure 3:
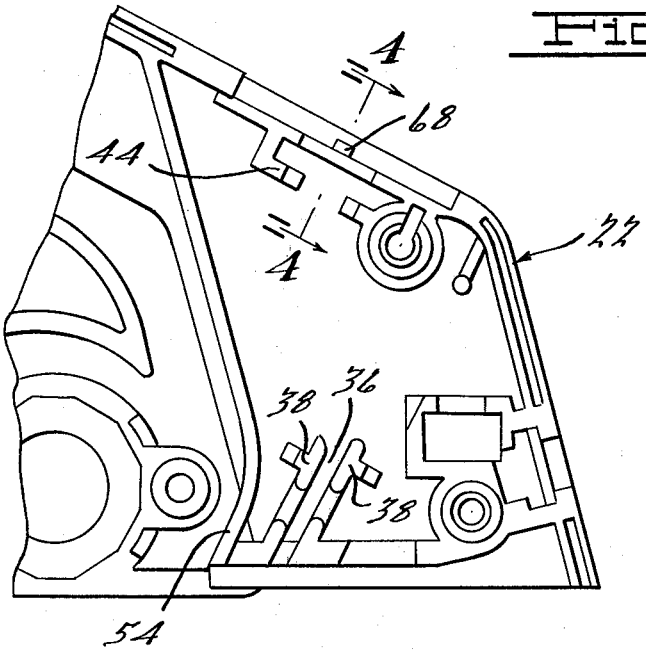
FIG. 3 is a side elevational view of the inside of the front end of the left-hand portion of the housing.
Figure 4:
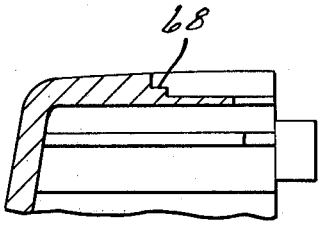
FIG. 4 is an enlarged sectional view of a portion of the housing half shown in FIG. 3 taken along line 4—4.

Referring to FIGS. 1 and 2, a portable power planer 20 of the type to which the present invention relates, is conventional in overall layout comprising a clamshell-type housing 22 incorporating a motor-driven cutter head 24 having mounted thereon a pair of cutting blade assemblies 26 for performing a planing operation of the surface of a workpiece as the cutter head 24 rotates. The bottom surface of the tool 20 comprises a fixed shoe 28 located rearwardly of the cutter head 24 and an adjustable front shoe 30 disposed forwardly of the cutter head 24. Elevational adjustment of the front shoe 30 causes a corresponding adjustment of the depth of cut of the cutting blades 26.

Figure 5:
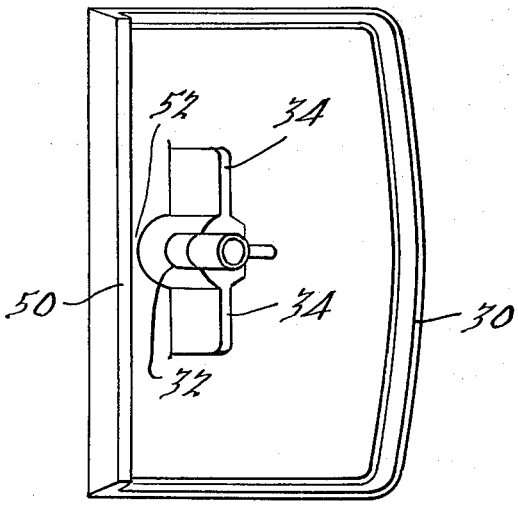
FIG. 5 is a top plan view of the adjustable front shoe according to the present invention.
Figure 6:
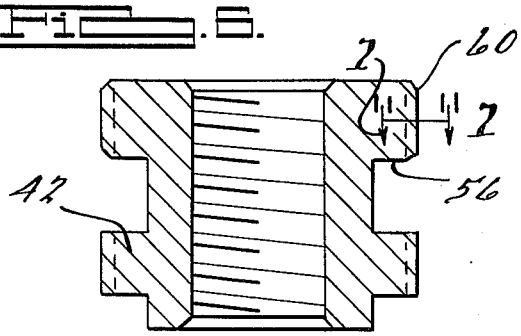
FIG. 6 is a sectional view of the elevation adjustment nut according to the present invention.

With additional reference to FIG. 5, the adjustable front shoe 30 includes an integral socket-like projection 32 extending upwardly and forwardly from the base thereof. Projection 32 also contains diametrically opposed radially outwardly extending integral flanges 34 which are adapted to be received within a pair of slots 36 (FIG. 3) formed by boss members 38 in housing 22. The left-hand housing member shown in FIG. 3 is illustrative of the complementary-shaped right-hand housing member. The flanges 34 serve to laterally stabilize the adjustable front shoe 30 as well as prevent the front shoe 30 from rotating relative to the housing 22.

An S-shaped rod 40 is fixedly mounted at one end in the socket-like projection 32 of adjustable front shoe 30. An elevation positioning nut 42 is threadedly engaged to the upper end of rod 40. Elevation positioning nut 42 is rotatably mounted within a race 44 formed in housing 22 by the joinder of the right-hand and left-hand halves. The race 44 permits rotation of elevation positioning nut 42 relative to the housing 22 but prevents elevational movement with respect thereto. Thus, it will be appreciated that when elevational positioning nut 42 is rotated, rod 40 and hence adjustable front shoe 30 are moved in elevation, thereby resulting in a variation in the depth of cut.

With particular reference to FIGS. 2 and 5, it will be noted that adjustable front shoe 30 has a ridge 50 formed along its rearward end which extends upwardly and forwardly at an acute angle from the base of the shoe 30. Ridge 50 together with the rearwardmost tangential surface of socket-like projection 32 form a slot 52 adjacent the back portion of projection 32 which is adapted to engage a downwardly projecting wall 54 formed in the housing 22. Ridge 50 coacts with downwardly projecting wall 54 to prevent rotation of adjustable front shoe 30 with respect to housing 22 and also to guide the elevational movement of front shoe 30. As best shown in FIG. 2, sufficient clearance is provided between downwardly projecting wall 54 and the base of front shoe 30 to permit adequate elevational adjustment in the position of front shoe 30. Also, as can be seen in FIG. 2, the slot 52 is inclined upwardly and forwardly.

Figure 7:
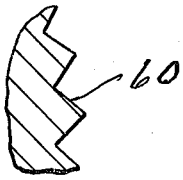
FIG. 7 is an enlarged sectional view of a portion of the elevation adjustment nut shown in FIG. 6 taken along line 7—7.
Figure 8:
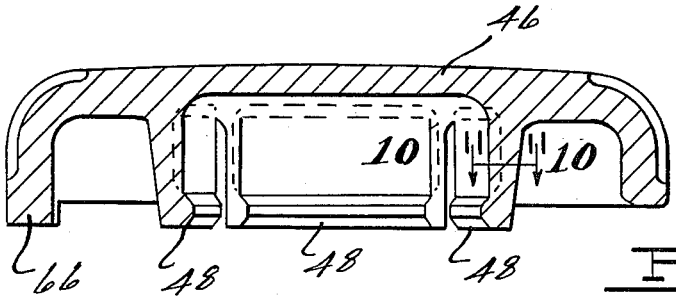
FIG. 8 is a sectional view of the adjustment cap of the present invention.
Figure 9:
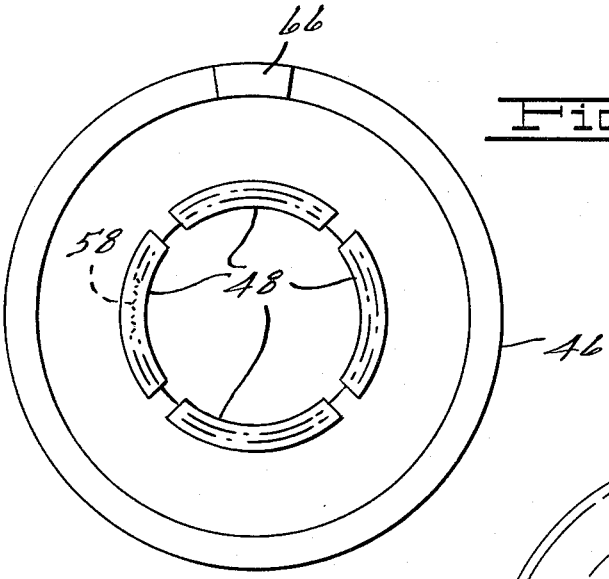
FIG. 9 is a bottom plan view of the adjustment cap shown in FIG. 8.
Figure 10:
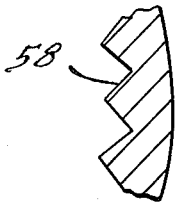
FIG. 10 is an enlarged sectional view of a portion of the adjustment cap shown in FIG. 8 taken along line 10—10.

Referring now additionally to FIGS. 8 and 9, a control knob 46 is fastened to elevation adjustment nut 42 so as to be exposed atop the forward end of housing 22. Control knob 46 is secured to adjustment nut 42 by means of a plurality of flexible fingers 48 which are adapted to grasp the undersurface of a circular ridge 56 formed around the nut 42. Control knob 46 is keyed to elevation adjustment nut 42 so as to rotate therewith by the mutual engagement of corresponding sets of fine teeth 58 and 60 formed on the inside surfaces of flexible fingers 48 of control knob 46 and the outer radial surface of ridge 56 of nut 42, respectively. The tooth configuration, shown in detail in FIGS. 7 and 10, is fine enough to permit precise angular positioning of control knob 46 relative to elevational adjustment nut 42 while at the same time providing a tight connection therebetween.

Figure 11:
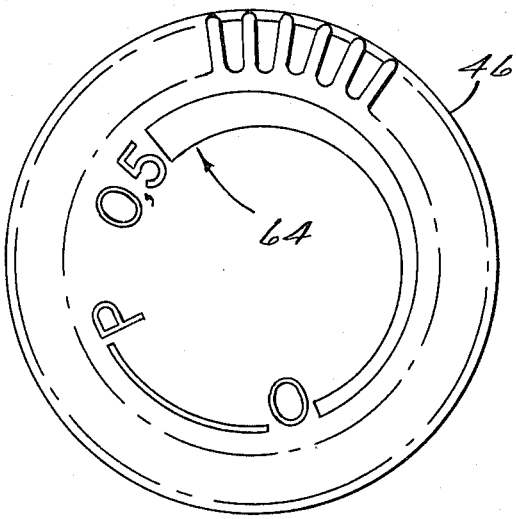
FIG. 11 is a top plan view of the adjustment cap shown in FIG. 8.
Figure 12:
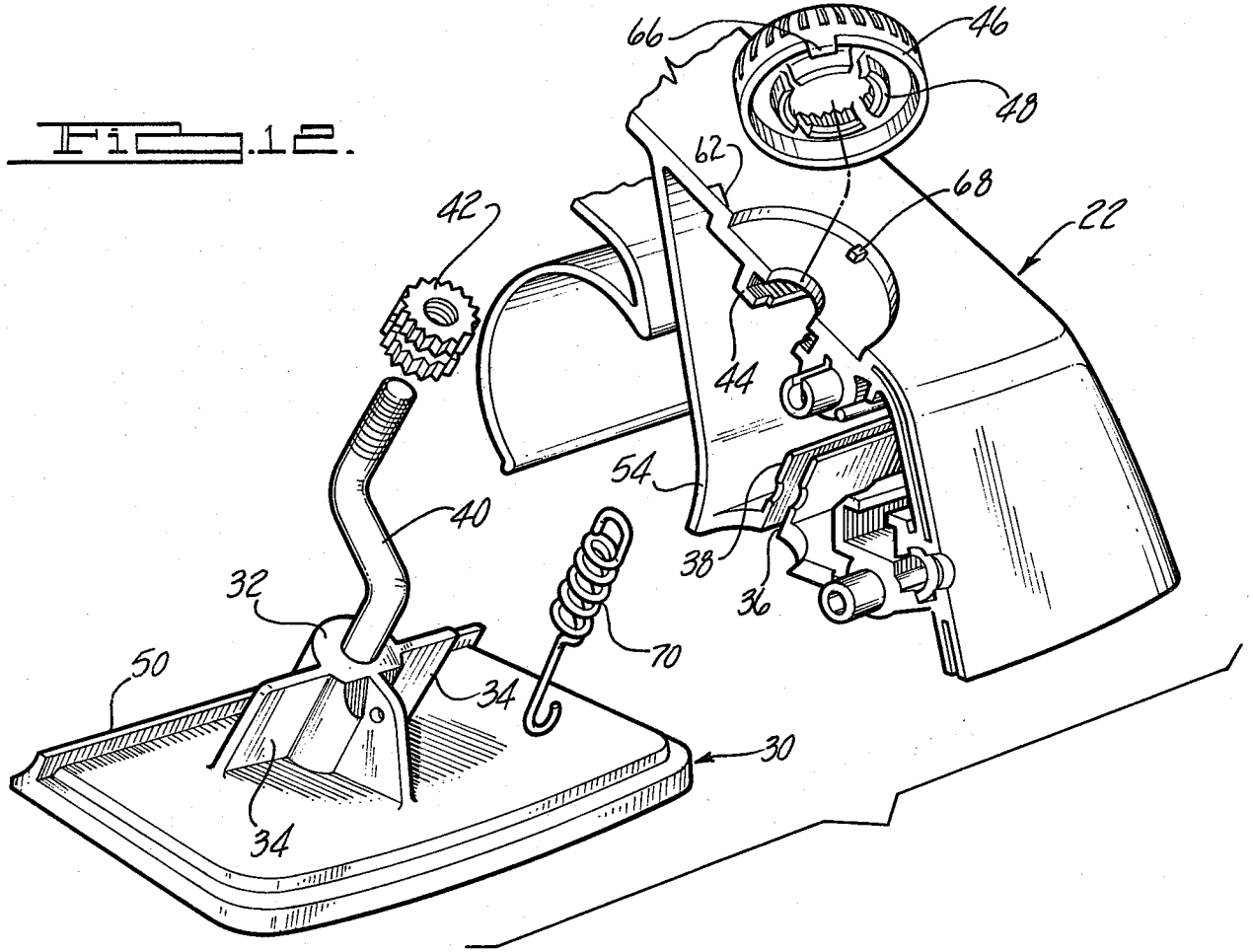
FIG. 12 is an exploded perspective view of the depth of cut adjustment mechanism of the present invention.

As best shown in FIG. 11, a scale 64 is provided on the top surface of control knob 46 which is referenced to an arrow 62 (FIG. 12) located on the outer surface of housing 22. The scale 64 on control knob 46 is calibrated in the following manner. Initially, with the control knob 46 removed, the elevation adjustment nut 42 is rotated until the adjustable front shoe 30 is located in the zero depth of cut position. The control knob 46 is then properly oriented and fastened onto elevation adjustment nut 42 in the manner described so that the reference arrow 62 on housing 22 is aligned with the zero indication on the scale. Thereafter, manual rotation of control knob 46 will cause rotation of elevation adjustment nut 42 and a corresponding variation in the elevational position of front shoe 30, which will be reflected in the reading on the control knob scale 64.

In addition, it will be noted that control knob 46 is provided with a downwardly projecting tab 66 which is adapted to abut a stop 68 located on the left-hand portion of housing 22. Engagement of the stop 68 by control knob 46 in the counterclockwise direction of rotation provides a positive "park" position wherein the adjustable front shoe is positioned below the zero depth of cut position to prevent the cutting blades 26 from marring the surface upon which the tool is placed. In the preferred embodiment herein, engagement of the stop 68 by the control knob 46 in the clockwise direction of rotation corresponds to the maximum cutting depth of 0.5 millimeters.

Returning to FIG. 2, a tension spring 70 is connected between the socket portion 32 of adjustable front shoe 30 and the front of housing 22. The spring 70 is maintained under tension and serves to cancel out any tolerance play which may exist between the adjustable front shoe 30 and the housing 22, thus avoiding a disconcerting wobble movement in the front shoe. In addition, it will be noted that tension spring 70 is disposed so that its axis is substantially parallel with the axes of S-shaped rod 40 at its upper and lower ends to prevent binding of adjustment nut 42. As can be appreciated from FIG. 2, these axes are all inclined forwardly. It is also preferred that spring 70 be mounted to the socket portion 32 of adjustable shoe 30 closely adjacent rod 40 to minimize the moment created by the slightly offset tension force of the spring 70 relative to the axes of rod 40. As can be seen in FIG. 2, the axis of the spring 70 is also substantially parallel to the upward inclination of the slot 52.

Significantly, it will be appreciated that, unlike conventional prior art mechanisms which utilize strong compression springs, the present tension spring 70 works with the operator as he bears down upon the tool during operation. Thus, at no point does the adjustable front shoe 30 appear to "float" as in the case of a compression spring when the force of the spring is balanced by the downward force exerted by the operator. In other words, because the present tension spring 70 works with the natural tendencies of the operator, the adjustable front shoe 30 is always maintained in the desired elevational position. In addition, as will readily be appreciated by those skilled in the art, the use of the substantially smaller tension spring 70 in combination with the S-shaped rod 40 significantly reduces the space required within the tool housing 22 when compared to conventional compression spring designs. Moreover, by eliminating the heavy compression spring of prior art designs, a significant reduction in manufacturing cost is also realized.

While the above description constitutes the preferred embodiment of the present invention, it will be appreciated that the invention is susceptible to modification, variation and change without departing from the proper scope or fair meaning of the accompanying claims.

What is claimed is:

1. A portable power planer, comprising:

a housing incorporating a motor driven cutting blade;

an adjustable shoe;

position control means, rotatably mounted in said housing so as to be fixed against elevational movement with respect thereto, for controlling the depth of cut of the cutting blade;

said housing and said adjustable shoe having coacting parts for guiding the elevational movement of said shoe and for preventing rotation of said shoe with respect to said housing;

said coacting parts comprising parts of said shoe extending upwardly from the base of said shoe and forming an upwardly inclined slot therebetween, and an internal downwardly projecting wall portion of said housing engaging in said slot;

a substantially S-shaped rod disposed within said housing and fastened at its lower end to said shoe and threadedly engaged at its upper end to said position control means such that rotation of said position control means results in elevational adjustment in the position of said shoe relative to said housing;

the axes of the upper and lower ends of said S-shaped rod being parallel and inclined to the base of said shoe;

a tension spring connected between said shoe, adjacent said rod, and said housing, and drawing said shoe towards said housing to firmly hold said shoe in the elevational position set by said position control means; and the axes of the upper and lower ends of said S-shaped rod, the axis of said tension spring, and the upward inclination of said slot all being substantially parallel.

2. The power planer of claim 1, wherein said position control means comprises a positioning nut mounted in a race formed in said housing.

3. The portable power planer of claim 1 wherein said position control means includes an adjustment nut and a control knob affixed to said adjustment nut for rotation therewith and having disposed thereon scale means referenced to a fixed reference on said housing for providing an indication of the depth of cut of the cutting blade.

4. The portable power planer of claim 3 wherein said position control means further includes means disposed at the interface between said control knob and said adjustment nut for positively affixing said control knob to said adjustment nut in a preselectable angular position relative thereto for permitting calibration of said scale means.

5. The portable power planer of claim 3 wherein said position control means further includes means for positively locating said control knob and adjustment nut in a predetermined angular position corresponding to the elevational position of said adjustable shoe being below the lowermost point of travel of said cutting blade.

6. A portable power planer, comprising:

a housing;

a motor-driven cutter head incorporated in said housing;

an adjustable front shoe connected to said housing and disposed forwardly of said cutter head;

a forwardly inclined socket-like projection extending upwardly from the base of said shoe;

a substantially S-shaped rod fixedly attached to said socket-like projection and extending upwardly therefrom, the axes of the upper and lower ends of said S-shaped rod being parallel and inclined forwardly;

an elevation positioning nut rotatably mounted in said housing and fixed against elevational movement relative thereto, the upper end of said rod being threadedly engaged in said nut;

an adjustment cap disposed atop said housing and affixed to said nut whereby rotation of said cap results in elevational movement of said adjustable shoe relative to said housing to adjust the depth of cut of said planer;

said housing and said adjustable shoe having coacting parts for guiding the elevational movement of said shoe;

said coacting parts comprising said socket-like projection, a ridge along the rearward end of said shoe extending upwardly and forwardly at an acute angle from the base of said shoe, and an internal downwardly projecting wall portion of said housing, said socket-like projection and said ridge defining an upwardly inclined slot in which said internal wall portion engages; and a spring connected under tension between said adjustable shoe and said housing, said spring having an axis which is substantially parallel to the axes of the upper and lower ends of said S-shaped rod and to the upward inclination of said slot, and said spring drawing said shoe upwardly and forwardly towards said housing to cancel out any tolerance play between said coacting parts, whereby unwanted movement and wobble of said adjustable shoe when an operator bears down on said planar during operation is eliminated.

7. The power planar of claim 6, wherein said spring is connected to said adjustable shoe closely adjacent said rod.

8. The power planer of claim 6, wherein said cap has disposed thereon scale means referenced to a fixed reference on said housing for providing an indication of the depth of cut, and wherein said cap and said nut have mutually engaging sets of fine teeth formed on the inside of said cap and the outside of said nut respectively, whereby said cap can be affixed to said nut in a preselectable angular position relative thereto to permit calibration of said scale means.

* * * * *